US011332284B1

(12) United States Patent
Smith-Ballard

(10) Patent No.: US 11,332,284 B1
(45) Date of Patent: May 17, 2022

(54) OPENABLE CONTAINER

(71) Applicant: Michelle Smith-Ballard, View Park, CA (US)

(72) Inventor: Michelle Smith-Ballard, View Park, CA (US)

( * ) Notice: Subject to any disclaimer, the term of this patent is extended or adjusted under 35 U.S.C. 154(b) by 0 days.

(21) Appl. No.: 17/188,337

(22) Filed: Mar. 1, 2021

(51) Int. Cl.
*B65D 43/16* (2006.01)
*B65D 85/36* (2006.01)

(52) U.S. Cl.
CPC ..... *B65D 43/161* (2013.01); *B65D 85/36* (2013.01); *B65D 2203/00* (2013.01); *B65D 2585/363* (2013.01)

(58) Field of Classification Search
CPC ..... B65D 5/42; B65D 5/4216; B65D 5/4233; B65D 5/425; B65D 43/16; B65D 43/161; B65D 85/36; B65D 2203/00; B65D 2585/363
USPC ..... 206/232, 459.5; 229/122
See application file for complete search history.

(56) References Cited

U.S. PATENT DOCUMENTS 3,379,359 A * 4/1968 Arneson ..... B65D 5/4204 229/122
3,831,834 A * 8/1974 Elward ..... B65D 5/322 229/122.23
3,900,104 A * 8/1975 Hamed ..... B65D 5/38 206/784
5,183,199 A * 2/1993 Bills ..... B65D 5/322 229/122
7,264,123 B2 * 9/2007 Reed ..... B65D 5/22 206/472
8,950,656 B2 * 2/2015 Nebeker ..... B65D 5/4208 229/116.5
2005/0218020 A1 * 10/2005 Lucas ..... B65D 5/4216 206/315.9
2014/0027500 A1 * 1/2014 Thorn ..... B65D 5/32 229/116.5

* cited by examiner

*Primary Examiner* — Bryon P Gehman
(74) *Attorney, Agent, or Firm* — Smyrski Law Group, A.P.C.

(57) ABSTRACT

A container is provided including a base, a front panel joined to the base, a right panel and a left panel joined to the base, two rear flaps positionable in a closed configuration comprising a first rear flap joined to the right panel and positionable perpendicular to the right panel and a second rear flap joined to the left panel and positionable perpendicular to the left panel, a rear panel joined to the base, and a top joined to the rear panel. The closed configuration includes the top oriented atop the front panel, right panel, and left panel and the rear panel proximate the two rear flaps. The container is employable in an open configuration wherein the rear panel and top are folded away from the front panel and the two rear flaps opened to non-perpendicular angles from the right panel and left panel such that an article can be horizontally inserted into or retrieved from the container.

20 Claims, 5 Drawing Sheets

OPENABLE CONTAINER

BACKGROUND OF THE INVENTION

Field of the Invention

The present invention relates generally to containers, and more specifically to containers for delicate products such as cakes.

Description of the Related Art

People transport items of certain fragilities using different types of devices and containers. Depending on the fragility and quality of the item transported, different solutions have been available with some success.

In the area of food and baked goods, such as high quality cakes, bakers frequently apply frosting to the exterior of the baked good which can as a result be challenging to transport and remove for display. Typical cake boxes include simple cardboard or other hard paper with four sides, a bottom, and a hinged top, where in some instances the assembly of the cardboard box includes tabs that can be folded into slots. Once transported the tabs can sometimes be removed from the slots and the cake lifted from the box. These simple cake boxes tend to be relatively inexpensive, but disassembling the box can be tricky, can cause the box to contact the frosting of the cake, and such simple boxes offer little in the way of appearance or presentation. They have typically been provided with a single exterior color, such as white or pink, and in some instances with a graphic of the selling retailer on the top of the box.

Special occasions can call for specialty cakes or other baked goods. In these instances, cakes or parts of cakes, such as the top layer, are sometimes kept for a period of time, such as a year, in a freezer. Such baked goods can provide special memories for the recipients or guests of honor. Brides and grooms in the United States sometimes will participate in a tradition of eating the remainder of their wedding cake, such as the topmost layer, on the first anniversary of their wedding. Such specialty baked goods, such as the tops of wedding cakes, are typically transported and/or maintained in the aforementioned common cardboard cake box. As a result, once the cake is eaten and the box and any remaining cake discarded, there is nothing that remains. There is no sentimental value attached to the baked good or the box containing the cake or other food item.

Further, some cake boxes are not easily disassembled. People frequently try to lift the cake from the cake box, and this can result in the person getting his or her fingers in the frosting on the exterior of the cake, or the cake frosted side or edge touching the side of the box. Frequently cakes take up much of the box and thus little room for error is available when extricating the cake from the box. One must put his or her hands in the box, put the fingers around the base which is typically a circle or a rectangle that fits flush with the sides of the box, and the user must then lift the cake out of the box. This maneuver requires significant dexterity and can nevertheless, even when great care is taken, result in the user contacting the frosting side of the cake with his or her fingers or brushing the exterior of the cake against the inside of the box. Cakes can be round or rectangular or take other shapes, such removal issues exist when lifting, for example, a rectangular cake from a similarly shaped box. And as noted, disassembling the box can result in contact between he interior of the box and the exterior of the cake or baked good(s). Contact with the exterior frosted sides or edges of cakes can not only harm the appearance of the cake but can also result in cleanliness or contamination issues.

Thus it would be advantageous to offer a container that addresses the deficiencies of prior containers, such as the deficiencies of prior food or cake containers.

SUMMARY OF THE INVENTION

According to one embodiment, there is provided a container comprising a base, a front panel joined to the base, a right panel and a left panel joined to the base, two rear flaps positionable in a closed configuration comprising a first rear flap joined to the right panel and positionable perpendicular to the right panel and a second rear flap joined to the left panel and positionable perpendicular to the left panel, a rear panel joined to the base, and a top joined to the rear panel. The closed configuration comprises the top oriented atop the front panel, right panel, and left panel and the rear panel proximate the two rear flaps. The container is employable in an open configuration wherein the rear panel and top are folded away from the front panel and the two rear flaps opened to non-perpendicular angles from the right panel and left panel such that an article can be horizontally inserted into or retrieved from the container.

According to a second embodiment, there is provided a container comprising a base, a front panel joined to a right panel and a left panel and joined to the base, and two rear flaps comprising a first rear flap joined to the right panel and positionable perpendicular to the right panel in a closed configuration and a second rear flap joined to the left panel and positionable perpendicular to the left panel in the closed configuration. The closed configuration comprises a top oriented atop the front panel, right panel, and left panel, and a rear panel joined to the top and base and proximate the two rear flaps. The container is employable in an open configuration wherein the rear panel and top are folded away from the front panel and the two rear flaps opened to non-perpendicular angles from the right panel and left panel such that an article can be horizontally inserted into or retrieved from the container.

According to a third embodiment, there is provided a container comprising a base affixed to a front panel, a right panel and a left panel, two rear flaps unconnected to the base and comprising a first rear flap joined to the right panel and positionable perpendicular to the right panel in a closed configuration, and a second rear flap joined to the left panel and positionable perpendicular to the left panel in the closed configuration. The closed configuration comprises a top oriented atop the front panel, right panel, and left panel, and a rear panel joined to the top and base and proximate the two rear flaps. The container is employable in an open configuration wherein the rear panel and top are folded away from the front panel and the two rear flaps opened to non-perpendicular angles from the right panel and left panel such that an article can be horizontally inserted into or retrieved from the container.

These and other advantages of the present invention will become apparent to those skilled in the art from the following detailed description of the invention and the accompanying drawings.

BRIEF DESCRIPTION OF THE DRAWINGS

For a more complete understanding of the present disclosure, reference is now made to the following figures, wherein like reference numbers refer to similar items throughout the figures.

DETAILED DESCRIPTION

The following description and the drawings illustrate specific embodiments sufficiently to enable those skilled in the art to practice the system and method described. Other embodiments may incorporate structural, logical, process and other changes. Examples merely typify possible variations. Individual elements and functions are generally optional unless explicitly required, and the sequence of operations may vary. Portions and features of some embodiments may be included in, or substituted for, those of others.

The present design includes a container having three sides fixed to a base, with a fourth or rear side comprising two divided panels not fixed to the base. The base of the device has a single panel adjoining the base as well as a cover piece with an optional front flap. An item disposed therein can be retrieved by the user opening the optional flap when present and the cover piece, lowering the cover and single panel away from the rear of the container, opening the two divided panels and retrieving the item from the rear of the container. As a result, there is minimal chance the user will harm the product contained therein.

In one embodiment, the container is a cake box and the article maintained is a frosted cake. Other objects may be carried or held in the container, including but not limited to baked goods, other food products, and other items, and the present design is not limited in this regard.

In one embodiment, a graphic may be applied to the article held inside, and a similar or related graphic or set of graphics may be provided on the container, making the container a desirable keepsake. In one embodiment, the graphic on the exterior of the box may be a photograph or visual representation of a person or persons, such as a wedding couple, and the interior product may bear a similar or identical graphic or set of graphics. Graphics on the product may be on the top or sides. In one embodiment, a wedding or other special occasion cake is provided with a picture of the wedding couple on the cake, and the container bears a similar or identical graphical representation of the wedding couple. The couple or a person having an interest may retain the container as a keepsake.

Figure 1:
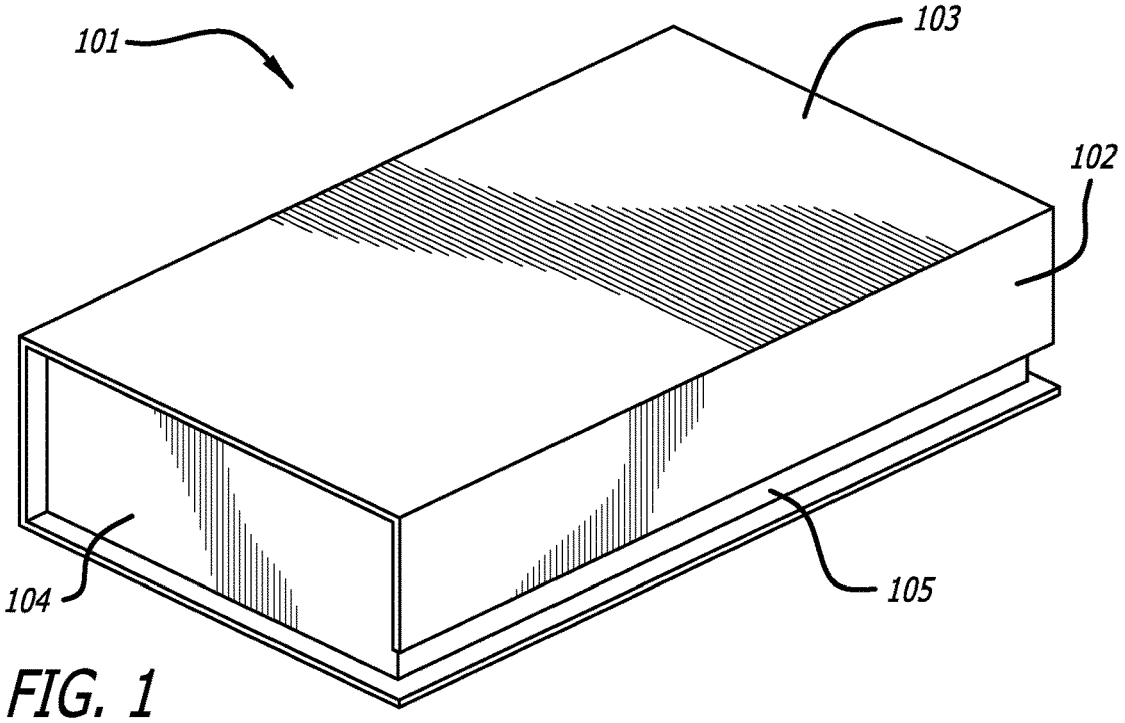
FIG. 1 is an upper left perspective view of the design in a closed configuration.
Figure 2:
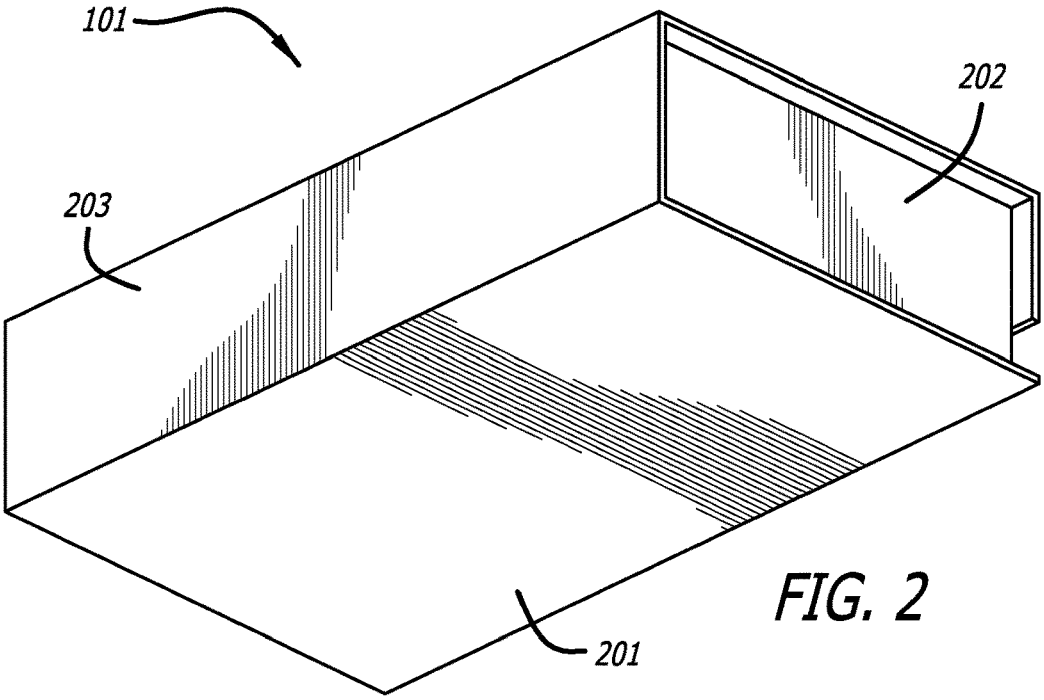
FIG. 2 is a lower right perspective view of the design.

FIG. 1 illustrates the general configuration of the container according to one embodiment. FIG. 1 is an upper left perspective view of the design that shows container 101 with optional flap 102, top 103, right side 104, and front side or front panel 105. FIG. 2 is a lower right perspective view of the design showing the container 101 as well as bottom or base 201, left side 202, and rear panel 203. Optional flap 102 need not be present, and in one embodiment optional flap 102 is not present, top 103 may be closed, and the container optionally secured, such as by using a string or ribbon.

The container 101 may be constructed of any material sufficient to hold what is to be maintained or transported therein, including a stiff cardboard or generally stiff material sufficient to maintain, for example, a cake. However, the container 101 may be constructed of any appropriate material or materials, and may include metal, wood, plastic, and outer adornments and/or materials. In one embodiment, container 101 is used to maintain a cake, such as a rectangular or round cake with icing or frosting. Thus the bottom 201 must be of sufficient strength to maintain the cake in such an embodiment, including the ability for a person to carry the container containing the cake. Different materials may be employed in the construction of the container 101, such as constructing the bottom 201 or base from one material or combination of materials and top 103, right side 104, front side or front panel 105, and/or left side 202 of different materials. Further, while not specifically shown in FIG. 1 or 2, the article or articles contained in container 101 may include additional components, such as support components. In an embodiment where the article being maintained or transported in container 101 is a frosted cake, a support item, such as a cardboard base, may be provided with the cake such that the cake rests on the cardboard base. Such a base not only supports the cake but can enable a user to readily insert and remove the cake located thereon.

Figure 3:
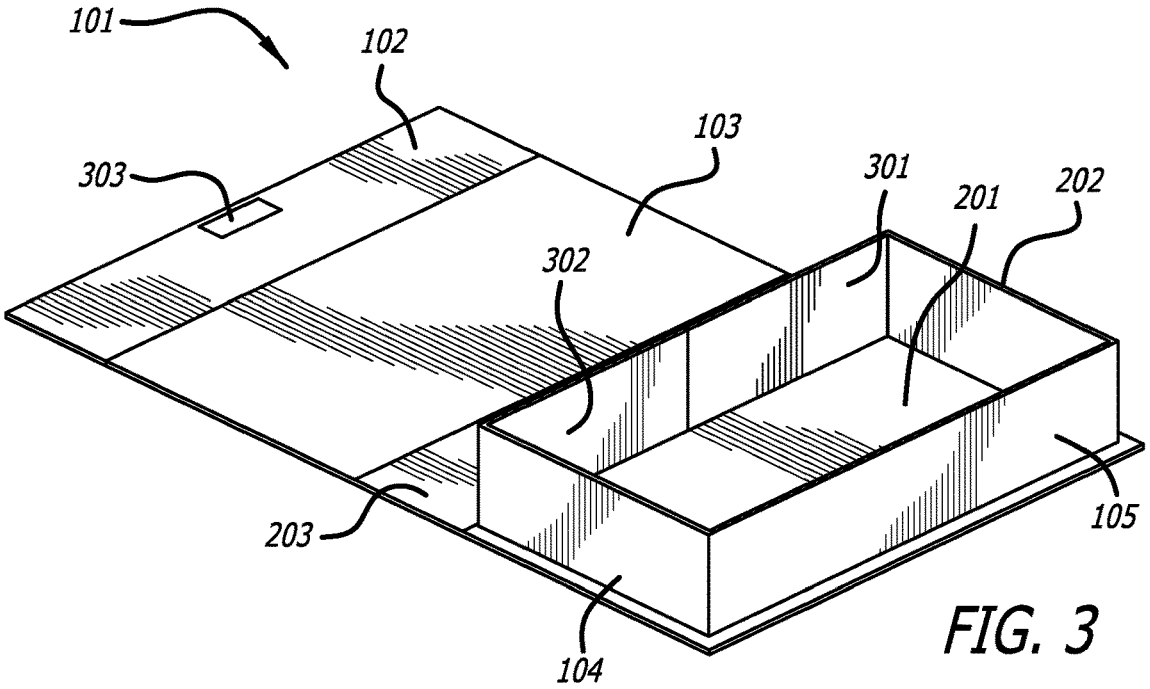
FIG. 3 is a top view of the container with the top and rear panel unfolded or opened away from the other components in an open configuration.

FIG. 3 is a top view of the container 101 with the top 103 and rear panel 203 unfolded or opened away from the other components and located, for example, on a flat surface behind container 101. The representation of FIG. 3 may be considered an open configuration as differentiated from the closed configuration of FIG. 1, for example. Other open configurations are possible in the present design. Shown in FIG. 3 is optional flap 102, bottom 201, right side 104, front side 105, and left side 202, as well as rear flaps 301 and 302. While shown of equal size in this representation, flaps 301 and 302 may be of different dimensions but are generally similar in height to right side 104, front side 105, and left side 202. When in a closed configuration, container 101 has rear panel 203 covering rear flaps 301 and 302. FIG. 3 also includes a joining component 303, provided with optional flap 102, which may be tape, hook and loop connector, or other connecting or affixing mechanism or component. While not shown in FIG. 3, there may be a receiving element on front side 105 that receives and secures joining component, but such a receiving element is optional.

Figure 4A:
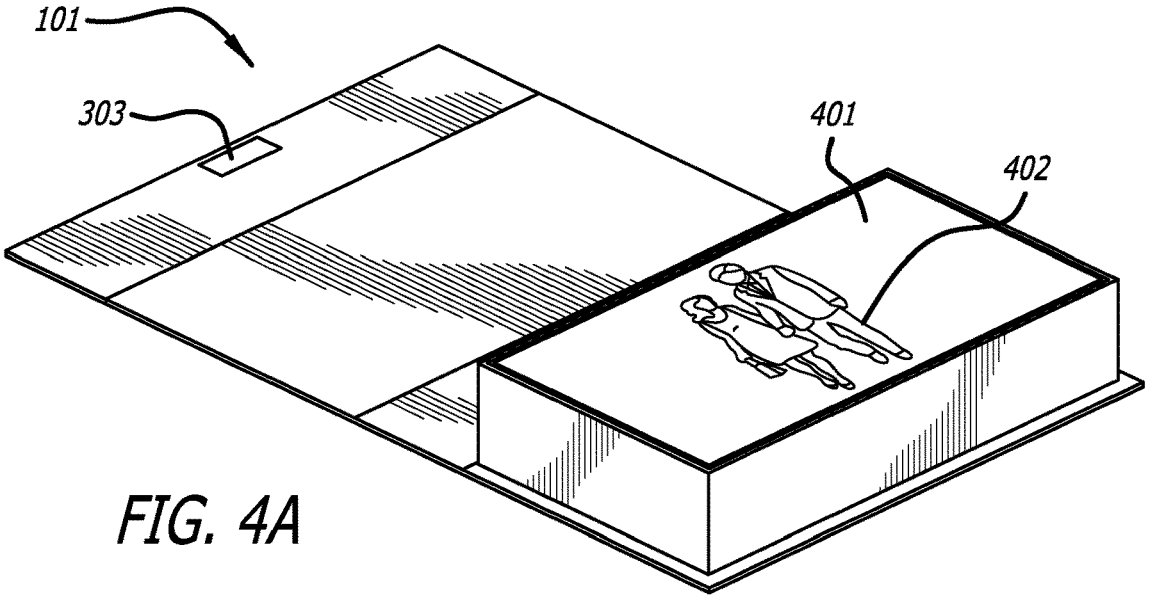
FIG. 4A illustrates the container opened with a rectangular cake located inside, the cake bearing a graphic.
Figure 4B:
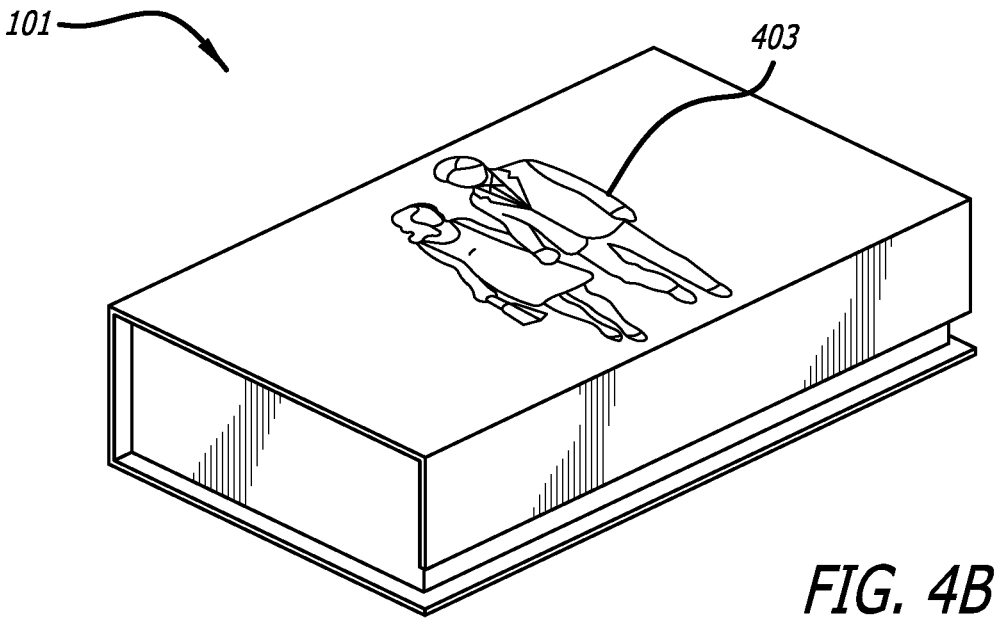
FIG. 4B is a perspective view of the container closed with an article or cake inside bearing a matching graphic generally illustrating the same or similar or related graphical material as is presented in graphic of FIG. 4A.

FIG. 4A illustrates the container 101, opened, with in this embodiment a rectangular cake 401 located inside, the cake bearing graphic 402. FIG. 4B is a perspective view of the container 101 closed with article or cake 401 inside (not shown in this view), bearing matching graphic 403, wherein the matching graphic generally illustrates the same or similar or related graphical material as is presented in graphic 402. As may be appreciated, a photograph of a couple getting married may be, for example, presented as graphic 402, and a portion of the photograph of the couple being married, such as a cropped version bearing text, may be provided as matching graphic 403. Further, the article, such as a cake, may include a graphical representation of a person having a birthday, while the container 101 may include other different graphical representations of the person having the birthday and in one embodiment text commemorating the birthday. Precise matching between graphics is not required, but a general relationship between the graphics presented may be provided. As a further example, a photograph may be provided as matching graphic 403 while a painting of the married couple may be provided on the cake as graphic 402. Other graphical representations may be employed, but a relationship between the graphical representations on the container and the article contained therein is typically present. Further, additional graphics may be provided on the article inside container 101, which in this embodiment is a cake, and/or on at least one surface of the container.

The container and/or article contained therein may include other decorative aspects, such as ribbons, text, patterns such as floral, geometric, or abstract representations, or virtually any representation desired.

Figure 5:
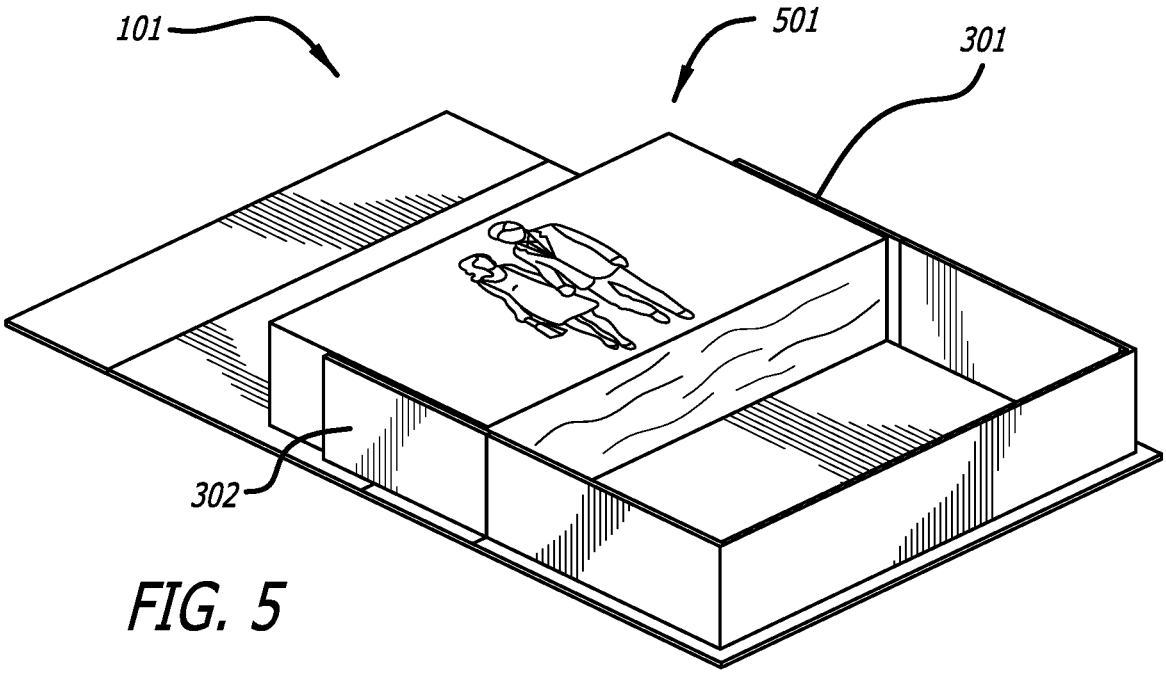
FIG. 5 shows a container with an article partially removed.

FIG. 5 shows container 101 with an article 501 partially removed. In one embodiment, article 501 is a rectangular cake having frosting applied. Rear flaps 301 and 302 are shown in an open configuration in this view. Such a divide between rear flaps 301 and 302 enables a user to easily remove the article horizontally. In the case of a cake, the user can readily remove the cake with his or her hands when, for example, the cake is located on a support element such as a piece of cardboard.

Figure 6:
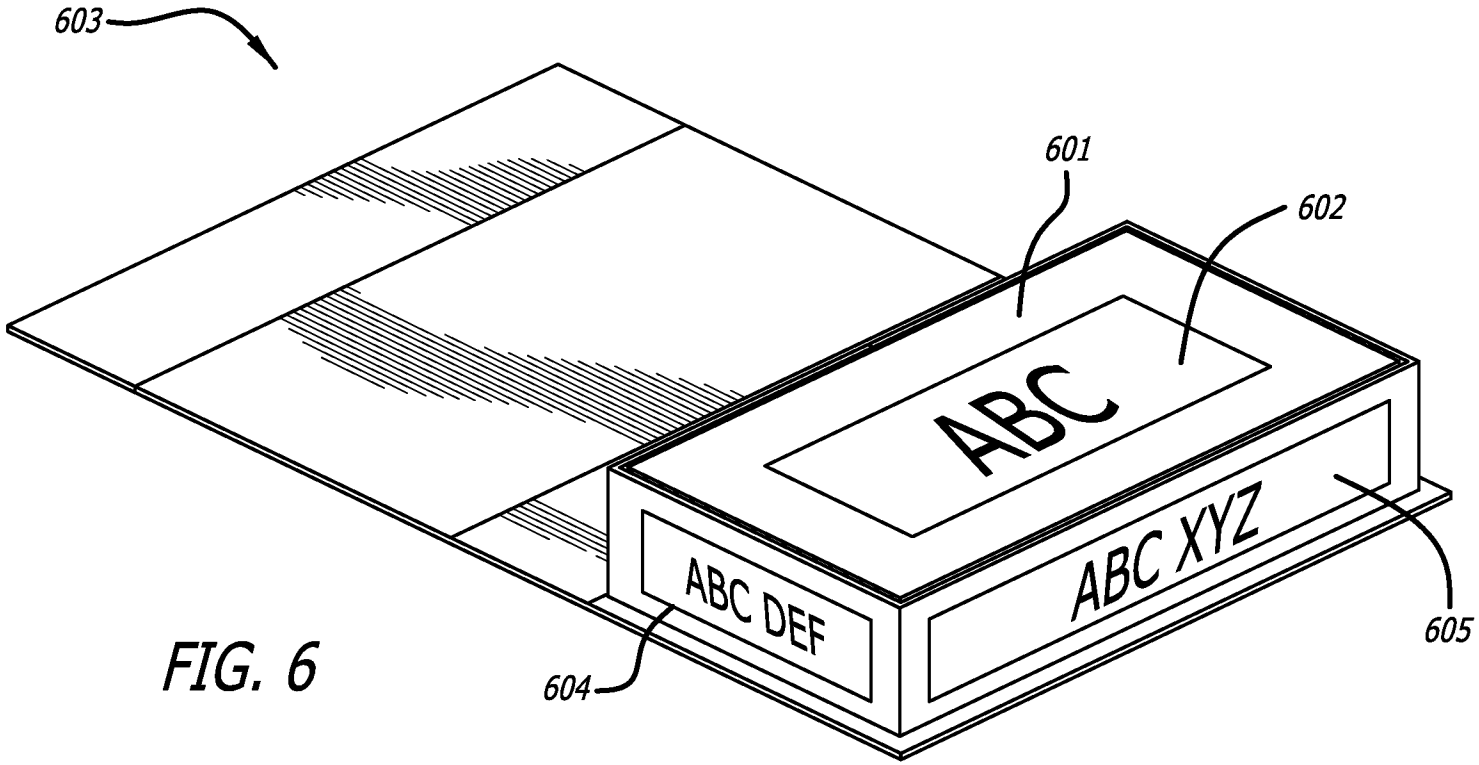
FIG. 6 shows an alternate version of an article bearing a graphic 502 and a container bearing a series of graphics including container graphics.

FIG. 6 shows an alternate version of an article 601 bearing a graphic 602 and a container 603 bearing a series of graphics including container graphics 604 and 605. Graphic 602 differs from but is related to graphics 604 and 605. Graphics may be provided anywhere and in any size, and may, for example, be provided on the interior or bottom or top of container 603.

Figure 7A:
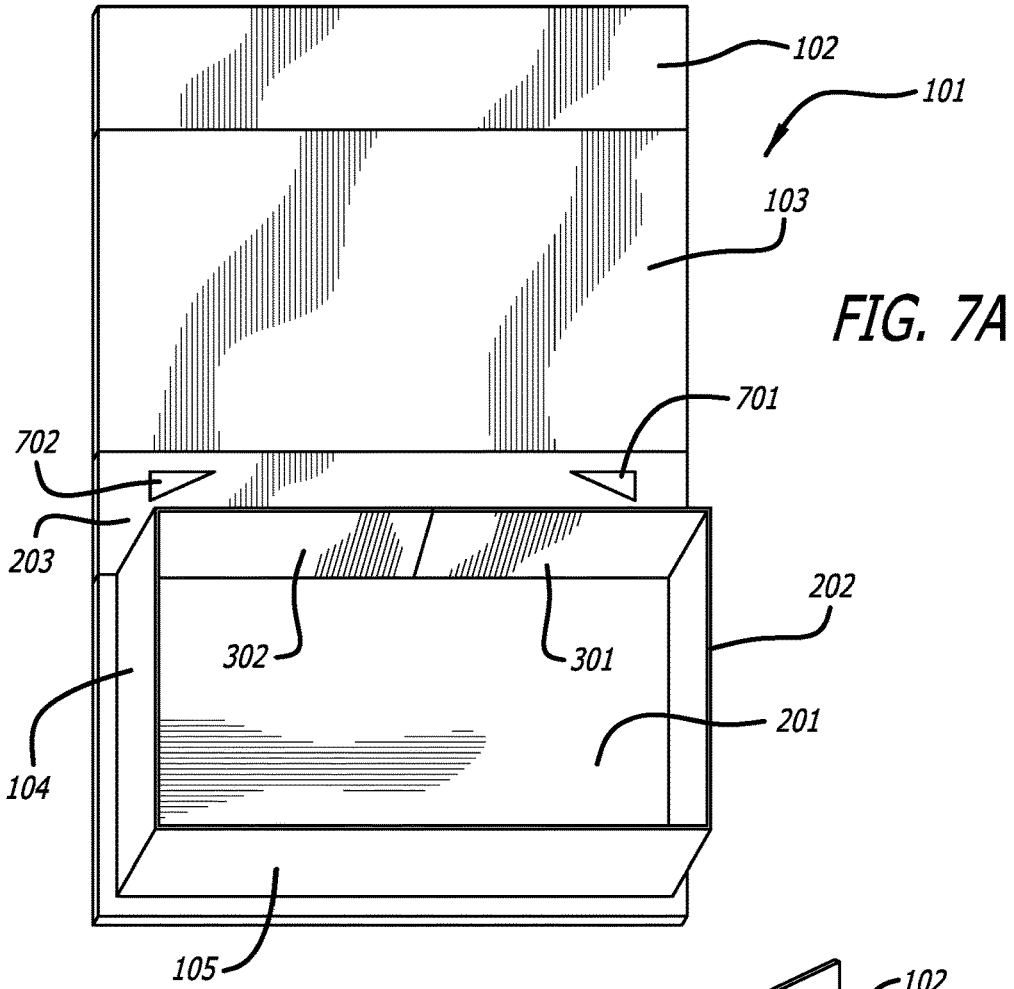
FIG. 7A illustrates a "keepsake" arrangement employing adhesive strips in this embodiment.
Figure 7B:
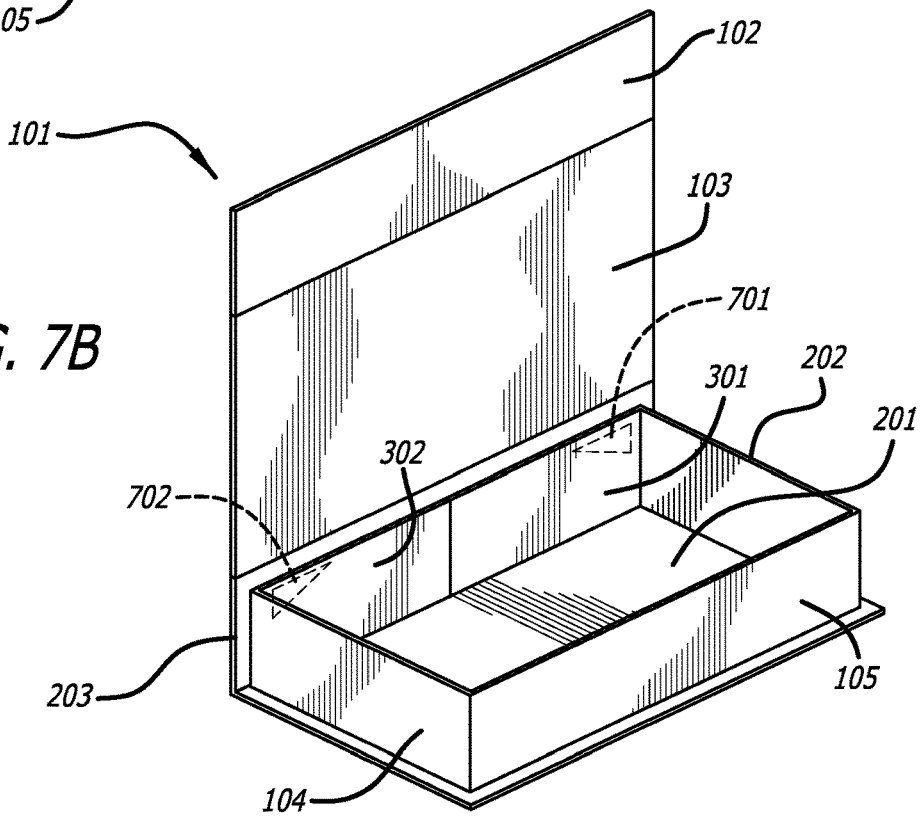
FIG. 7B shows the "keepsake" arrangement of FIG. 7A with the rear panel joined to the flaps using the adhesive strips.

FIG. 7A shows a "keepsake" arrangement wherein in one embodiment adhesive or other securing components or elements are provided. In this view, adhesive elements 701 and 702 are provided, and generally comprise adhesive on the front and rear sides, potentially covered by a covering such as paper or a film. The user may expose an adhesive side and affix the adhesive side of adhesive elements 701 and 702 to the inside of rear panel 203. The user may then remove the covering or coverings from adhesive elements 701 and 702 and join rear panel 203 to flaps 301 and 302. This secures the rear panel 203 to flaps 301 and 302 as shown in FIG. 7B, and as a result the container 101 may be used to keep anything therein as a keepsake without the rear panel 203 folding down or the flaps 301 and 302 moving. FIG. 7B shows ghosted versions of adhesive elements 701 and 702 sandwiched between rear flaps 301 and 302 and rear panel 203.

It is to be understood that various different securing or affixing elements may be employed, including a single securing or affixing element, where such securing or affixing elements may include but are not limited to hook and loop fasteners, clips, two sided tape, or even glue or other adhesives. Also, while shown as triangles in FIGS. 7A and 7B, securing, affixing, or adhesive elements may take any shape, and any number of securing, affixing, or adhesive elements may be employed, including one, three, or more. The noteworthy attribute is the ability to join rear panel 203 to flaps 301 and 302 so minimal movement of these components occurs.

Also, while FIGS. 7A and 7B show adhesive elements 701 and 702 placed on the inside of rear panel 203, such adhesive elements or affixing elements may alternately be initially placed or positioned on the rear sides of flaps 301 and 302, in similar positions, such that when rear panel 203 is positioned or located next to flaps 301 and 302 bearing the adhesive or affixing elements, they secure the flaps to the rear panel. They key in this "keepsake" configuration is securing the flaps and the rear panel.

Thus according to one embodiment, there is provided a container comprising a base, a front panel joined to the base, a right panel and a left panel joined to the base, two rear flaps positionable in a closed configuration comprising a first rear flap joined to the right panel and positionable perpendicular to the right panel and a second rear flap joined to the left panel and positionable perpendicular to the left panel, a rear panel joined to the base, and a top joined to the rear panel. The closed configuration comprises the top oriented atop the front panel, right panel, and left panel and the rear panel proximate the two rear flaps. The container is employable in an open configuration wherein the rear panel and top are folded away from the front panel and the two rear flaps opened to non-perpendicular angles from the right panel and left panel such that an article can be horizontally inserted into or retrieved from the container.

According to a second embodiment, there is provided a container comprising a base, a front panel joined to a right panel and a left panel and joined to the base, and two rear flaps comprising a first rear flap joined to the right panel and positionable perpendicular to the right panel in a closed configuration and a second rear flap joined to the left panel and positionable perpendicular to the left panel in the closed configuration. The closed configuration comprises a top oriented atop the front panel, right panel, and left panel, and a rear panel joined to the top and base and proximate the two rear flaps. The container is employable in an open configuration wherein the rear panel and top are folded away from the front panel and the two rear flaps opened to non-perpendicular angles from the right panel and left panel such that an article can be horizontally inserted into or retrieved from the container.

According to a third embodiment, there is provided a container comprising a base affixed to a front panel, a right panel and a left panel, two rear flaps unconnected to the base and comprising a first rear flap joined to the right panel and positionable perpendicular to the right panel in a closed configuration, and a second rear flap joined to the left panel and positionable perpendicular to the left panel in the closed configuration. The closed configuration comprises a top oriented atop the front panel, right panel, and left panel, and a rear panel joined to the top and base and proximate the two rear flaps. The container is employable in an open configuration wherein the rear panel and top are folded away from the front panel and the two rear flaps opened to non-perpendicular angles from the right panel and left panel such that an article can be horizontally inserted into or retrieved from the container.

The foregoing description of specific embodiments reveals the general nature of the disclosure sufficiently that others can, by applying current knowledge, readily modify and/or adapt the system and method for various applications without departing from the general concept. Therefore, such adaptations and modifications are within the meaning and range of equivalents of the disclosed embodiments. The phraseology or terminology employed herein is for the purpose of description and not of limitation.

What is claimed is:

1. A container comprising:

a base;

a front panel joined to the base;

a right panel and a left panel joined to the base;

two rear flaps positionable in a closed configuration, the two rear flaps comprising:

a first rear flap joined to the right panel and positionable perpendicular to the right panel; and a second rear flap joined to the left panel and positionable perpendicular to the left panel;

a rear panel joined to the base; and a top joined to the rear panel;

wherein the closed configuration comprises the two rear flaps oriented at perpendicular angles from the right panel and left panel, the top oriented atop the front panel, right panel, and left panel, and the rear panel proximate the two rear flaps;

wherein the container is employable in an open configuration wherein the rear panel and top are folded away from the front panel and the two rear flaps opened to non-perpendicular angles from the right panel and left panel such that an article can be horizontally inserted into or retrieved from the container.

2. The container of claim 1, further comprising a front flap joined to the top and configured to fold over the front panel when the container is in the closed configuration.

3. The container of claim 2, further comprising a securing apparatus affixed to at least one of the front flap and the front panel enabling securing the front flap and the front panel.

4. The container of claim 1, wherein the article comprises a graphic.

5. The container of claim 4, wherein the container comprises a matching graphic, the matching graphic corresponding to the graphic on the article.

6. The container of claim 1, wherein the article comprises a cake.

7. The container of claim 6, wherein the cake comprises a frosted cake.

8. The container of claim 1, wherein the first rear flap and the second rear flap are secured to the rear panel using at least one securing element.

9. A container comprising:

a base;

a front panel joined to a right panel and a left panel and joined to the base; and two rear flaps comprising:

a first rear flap joined to the right panel and positionable perpendicular to the right panel; and a second rear flap joined to the left panel and positionable perpendicular to the left panel;

wherein the closed configuration comprises the two rear flaps positioned at perpendicular angles from the right panel and left panel, a top oriented atop the front panel, right panel, and left panel, and a rear panel joined to the top and base and proximate the two rear flaps;

wherein the container is employable in an open configuration wherein the rear panel and top are folded away from the front panel and the two rear flaps opened to non-perpendicular angles from the right panel and left panel such that an article can be horizontally inserted into or retrieved from the container.

10. The container of claim 9, further comprising a front flap joined to the top and configured to fold over the front panel when the container is in the closed configuration.

11. The container of claim 10, further comprising a securing apparatus affixed to at least one of the front flap and the front panel enabling securing the front flap and the front panel.

12. The container of claim 9, wherein the article comprises a graphic representation thereon.

13. The container of claim 12, wherein the container comprises a matching graphic, the matching graphic corresponding to the graphic representation on the article.

14. The container of claim 9, wherein the article comprises a cake positioned on a holder.

15. The container of claim 9, wherein the first flap and the second flap are secured to the rear panel using at least one securing element.

16. The container of claim 15, wherein the first flap and the second flap are equal in size.

17. A container comprising:

a base affixed to a front panel, a right panel and a left panel; and two rear flaps unconnected to the base and comprising:

a first rear flap joined to the right panel and positionable perpendicular to the right panel; and a second rear flap joined to the left panel and positionable perpendicular to the left panel;

wherein the closed configuration comprises the two rear flaps positioned at perpendicular angles from the right panel and left panel, a top oriented atop the front panel, right panel, and left panel, and a rear panel joined to the top and base;

wherein the container is employable in an open configuration wherein the rear panel and top are folded away from the front panel and the two rear flaps opened to non-perpendicular angles from the right panel and left panel such that an article can be horizontally inserted into or retrieved from the container.

18. The container of claim 17, wherein the article comprises a cake.

19. The container of claim 18, wherein the cake has a graphic representation provided thereon.

20. The container of claim 19, wherein the container comprises a matching graphic, the matching graphic corresponding to the graphic representation provided on the cake.

* * * * *